US006485444B1

(12) United States Patent
Gershov

(10) Patent No.: US 6,485,444 B1
(45) Date of Patent: Nov. 26, 2002

(54) BACK AND FOOT CARE APPARATUS

(76) Inventor: Vladimir Gershov, 79 Saco St., Newton, MA (US) 02464

( * ) Notice: Subject to any disclaimer, the term of this patent is extended or adjusted under 35 U.S.C. 154(b) by 0 days.

(21) Appl. No.: 09/714,241

(22) Filed: Nov. 16, 2000

Related U.S. Application Data

(60) Provisional application No. 60/167,457, filed on Nov. 24, 1999.

(51) Int. Cl.[7] ..... A61H 7/00

(52) U.S. Cl. ..... 601/138; 601/137; 601/136; 15/222

(58) Field of Search ..... 601/136, 137, 601/138, 143, 114; 15/222

(56) References Cited

U.S. PATENT DOCUMENTS 1,746,075 A * 2/1930 Edwards
6,012,195 A * 1/2000 Lindsay ..... 15/222
6,098,233 A * 8/2000 Chen ..... 15/110

* cited by examiner

*Primary Examiner*—Michael A. Brown
*Assistant Examiner*—Benjamin K. Koo
(74) *Attorney, Agent, or Firm*—Mirick, O'Connell, DeMallie & Lougee, LLP

(57) ABSTRACT

The invention discloses a self-treatment body care apparatus that can be manipulated easily to reach the back of the user. The frame can be enlarged or collapsed. Additionally, the apparatus of the invention has a base which (1) allows the invention which is a frame to stand upright, (2) provides interchanging applicators and massaging devices for a variety of applications, and (3) can be used as a foot massager or scrubber while the user is seated or standing.

24 Claims, 9 Drawing Sheets

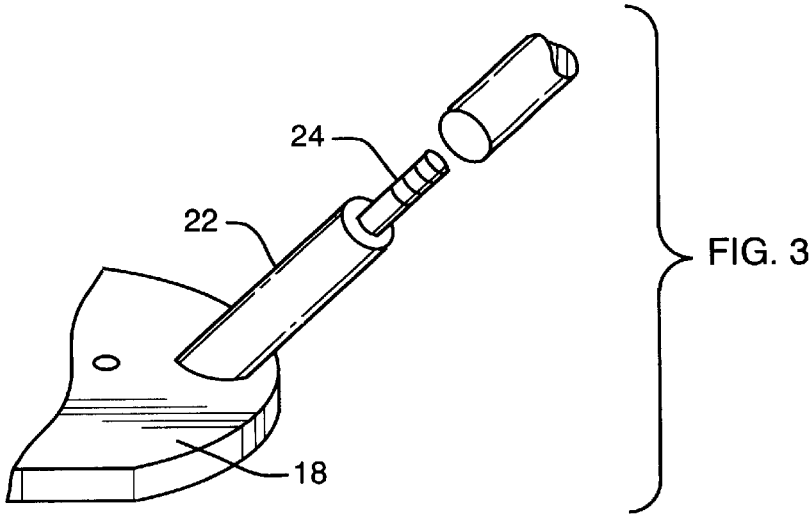
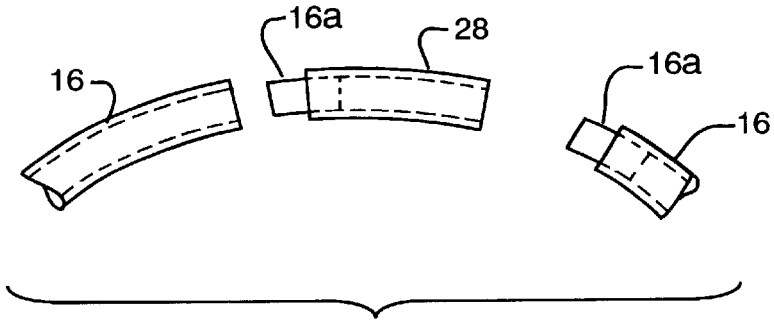
FIG. 4
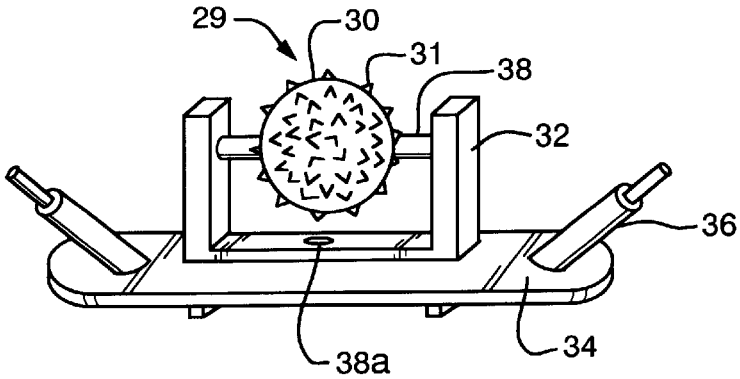
FIG. 5

BACK AND FOOT CARE APPARATUS

This application claims the benefit of provisional application 60/167,457 filed Nov. 24, 1999.

FIELD OF THE INVENTION

The present invention relates to body care devices, and more particularly relates to body care devices that are manipulated by the user to reach difficult areas.

BACKGROUND OF THE INVENTION

Body care devices with a hoop or circular shaped frame usually attach an applicator to the frame which is manipulated to reach areas on the body that are difficult to reach due to infirmity or age. The applicators, such as massagers, brushes or sponges, are attached to the frame by a plate. One such device is disclosed in U.S. Pat. No. 4,718,409 issued Jan. 12, 1988 to Uri Gershov et al. The '409 patent teaches the use of applicators on a circular frame. This frame cannot stand on its own and requires plates be attached to the periphery of the frame by a lock or clamping device. The clamping device is difficult to manipulate due to the force required to fix the place frame such that it does not slip.

Similar devices are disclosed in U.S. Pat. No. 3,957,039 issued May 18, 1976 to Fritz A. Ehrens and U.S. Pat. No. 3,814,085 issued to Edward C. Kupchinski. These devices have fixed applicators.

The main defects discovered in the prior art are: (1) the locks connecting the backing element of the frame allow for slippage of the backing element or are difficult to manipulate; (2) the shape of the frame is distorted after prolonged use due to the attachment of the backing element by locks or clamps; (3) the massager adapter is fixed on the backing element and limits the efficiency of massaging the back; (4) the massager adapter and the medical applicator only use one rotator; (5) the construction of the device is not strong enough for treatment of the feet which would bend the frame when pressure is applied; and (6) the frame could not be immobilized when stood upon.

Thus, there is a need in the art to improve the quality of current body care devices, to make it more effective and easier to operate, and to reduce its cost by making construction simpler.

SUMMARY OF THE INVENTION

The present invention overcomes limitations in the prior art by providing in one feature a base for the apparatus which allows it to stand upright and thereby be easily stored. Additionally, the plate or base is preferably attached to open ends of the circular shape frame thereby eliminating the need to lock or clamp the plate to the periphery of the frame. Also, many different applicators can be used with one frame because the plate can be mounted removably if the applicator is permanently affixed to the plate, and some applicators can be removably attached to plates. A designer would be guided to attach some or all applicators permanently to the plates depending on what types of stresses will be placed on the applicator. Greater stresses usually indicate that the applicator should be permanently fixed to prevent slippage and wear to avoid the expected wear caused by the applicator moving at the point of attachment to the base.

A body care applicator fixed to a backing element is removably and replaceably mounted on a human body encircling frame of shapeable tubular material, such as wood, metal or plastic. The frame is separable at a junction.

The frame may be a one whole piece, or an assembly of multiple pieces. A segment (or more than one) may be inserted at the junction to enlarge the frame. Part of the encircling frame with joint connection to the backing element may be used as a revolving curved handle for the body care device. A plurality of units having a body care appliance fixed to a backing element (or, removable appliances fixable to one or more backing elements) are provided which enable the use of the invention for diverse self-treatment body care functions at the dorsal area of the body such as scrubbing, massaging, application of a heating pad and application of body care creams and lotions.

BRIEF DESCRIPTION OF THE DRAWINGS

FIG. 3 is a fragmentary perspective view of an applicator backing element for the invention, illustrating a clamping mechanism suitable for use with the present invention.

FIG. 4 is a fragmentary, exploded perspective view of the preferred applicator loading element illustrating the use of a series of interlocking insertable segments.

FIGS. 5 and 6 are elevation views illustrating a body care applicator for the invention employing revolving massagers.

DETAILED DESCRIPTION OF THE PREFERRED EMBODIMENTS

Figure 1:
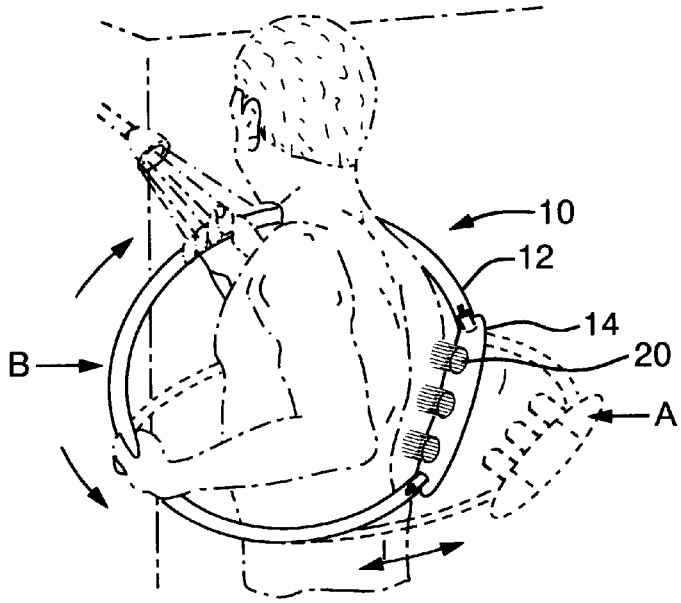
FIG. 1 is a diagram in perspective illustrating one embodiment of the invention in use.

The present invention discloses a self-treatment body care apparatus preferably having an open ended frame for circumscribing a portion of a human torso; a base which attaches to the openings in the ends of the frame, and an applicator which attaches to the base. The applicator can be a scrubbing brush, a sponge, an absorbent pad, a massaging device, a foot massaging device, or a medicinal applicator, or other similar instruments readily recognizable by those of ordinary skill in the art. In a preferred embodiment, the applicator revolves around an axis parallel or orthogonal to a surface of the user, such as the torso or foot.

In a preferred embodiment, the open ends of the frame releasably attach to the base, such that the frame can be attached and detached numerous times without damaging the frame or the base. In a particularly preferred embodiment, the frame is a plastic material, and the frame is collapsible. This allows easy shipment and storage of the apparatus. According to one practice, the frame forms a handle for the base. The frame can have interlocking sections, and can be enlarged by adding interlocking sections to the frame to accommodate a larger torso.

In a preferred embodiment, the applicator is attached releasably to the base. The applicator or its elements can revolve around an axis, such as when used as a massager or to apply medicines. The applicator can employ any suitable number of rotating elements, and preferably includes two or more rotating elements.

In a preferred embodiment, the base is relatively flat, or has projecting portions, to allow the apparatus to stand upright.

The term "open ended frame" as used herein refers to the portion of a frame which is not replaced by the interchangeable applicator portion of the apparatus.

The term "base" as used herein refers to the plate or device which connects to the open ends of a frame thereby forming a continuous periphery between the combination of the frame and the base. The applicators are fixed to the base. A flat base means the base causes the device to stand upright on a floor or other surface. A footed base has protruding feet which rest on the floor to allow the device to stand upright.

An applicator is a device that can contact a region on the body to apply pressure and/or apply a substance such as a topical medicine. A side variety of applicators are contemplated for use in the subject invention.

The term "collapsible" as used herein means the device can be disassembled or selected portions of the frame are telescoping relative to each other. One method of disassembly involves inserting smaller segments of the frame into larger segments of the frame, such as with a collapsible antenna.

The term "interlocking" or "interconnecting" as used herein means the segments become fixed or are coupled to each other, at least temporarily, such that the device can withstand the rigors of use without becoming disassembled. One method of interlocking includes the use of threaded inserts in the frame in order to fit together complementary adjacent sections. Another method of interlocking includes a spring loaded button which locks into a hole in the adjacent section. However, any device for connecting pieces of a frame can be used.

The term "handle" as used herein refers to a region on the body care device which can be used to control the working portion or applicator without having to manipulate the applicator by hand.

The self-treatment body care device of the present invention can be employed to access the dorsal area of the torso. The body care device comprises a frame which extends at least partially and, preferably, entirely about the body and supports, alternatively, diverse body applicators attached to a base. A plurality of different types of applicators may be provided including, for example, a scrubber, a massager, a heating pad and a medicine applicator. The applicators may be mounted on a rigid backing element or base. The base may include a branch or receiving portion on each end for connection with the frame. The frame may be a single or unitary component or can employ multiple components. Part of the frame can be used as a revolving curved handle device that can be connected with additional segments to form the full frame of the body care device.

The revolving curved handle can also be rotated around the axis of the clamping element, thereby providing a variable angle between the backing element and the handle. The massager and medical applicator revolve around their axes, and in some cases the axis of the backing element, thus improving the ability to control placement of the applicator.

Applicators can be a wide variety of devices and can be chosen to suit a particular purpose. Particularly preferred applicators are a removable massager with a plurality of rotating portions, and a removable medicine applicator that allows the application of a topical medicine.

A body care appliance or applicator fixed to a backing element or base is removably and replaceably mounted on a human body encircling frame of flexible tubular or other cross section plastic material. The frame is separable at a junction. The frame may be a one whole piece, or a multi-piece assembly. A segment may be inserted at the junction to enlarge the frame. Part of the encircling frame with joint connection to the backing element used as a revolving curved handle for body care device. A plurality of units having a body care appliance fixed to a backing element are provided which enable the use of the invention for diverse self-treatment body care functions at the dorsal area of the body such as scrubbing, massaging, application of a heating pad and application of body care creams and lotions.

Figure 2:
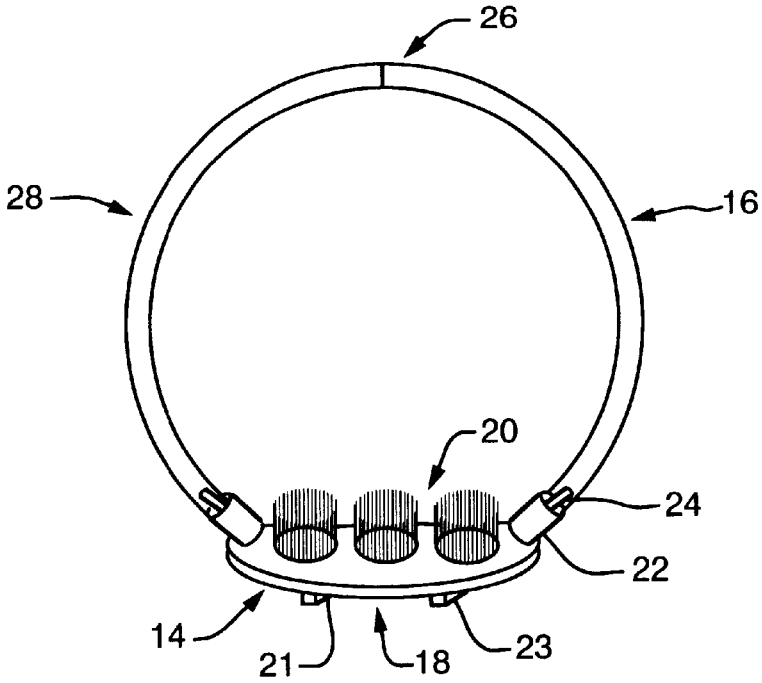
FIG. 2 is a perspective view of the embodiment of FIG. 1 with one form of body applicator assembly in place.

Referring now to the drawings, a self-treatment body care device 10 is illustrated in FIGS. 1 and 2 comprising a frame assembly 12 and a body applicator assembly 14 exemplified by a scrubbing brush assembly 14*a* removably mounted thereon.

The illustrated frame assembly 12 can include an open circular frame element 16 formed of plastic, wood or metal, which can be attached to the body applicator assembly 14 to form a closed loop. The frame element 16 is separable as shown at junction 26 to form a plurality of separable, interlocking frame components 16 and 28. At the junction 26, one end of one of the frame components includes a reduced diameter projection 16*a* (FIG. 4), sized for seating within an adjacent frame component. For example, frame component 28 includes the projection 16*a* which seats within the adjacent frame component 16. A number of frame components can be employed to expand the size of the overall device (e.g., diameter, circumference or arc of the frame).

With reference to FIGS. 2–6, the body applicator assembly 14 includes a backing element or base 18 includes a flat rigid element of plastic or other similar material. At the end of each side of the backing element are clamping elements 22 and 24. The clamping elements can be integrally formed with the backing element, and are designed to connect with the frame elements at an outwardly projecting end (clamp element 24). As illustrated in FIGS. 2 and 3, the clamping element 24 forms an outwardly projecting portion that is sized and dimensioned for seating within corresponding ends or portions of the frame assembly 12. When the frame assembly 12 is coupled to both sets of clamping elements, the circular body care device 10 is formed.

Figure 6:
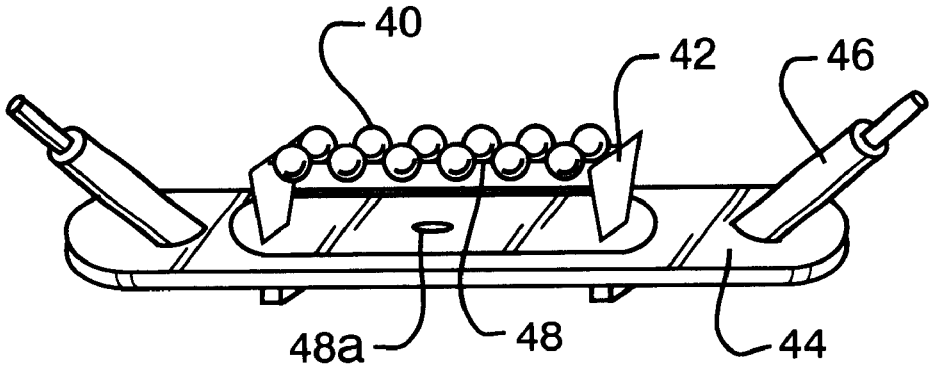
Figure 7:
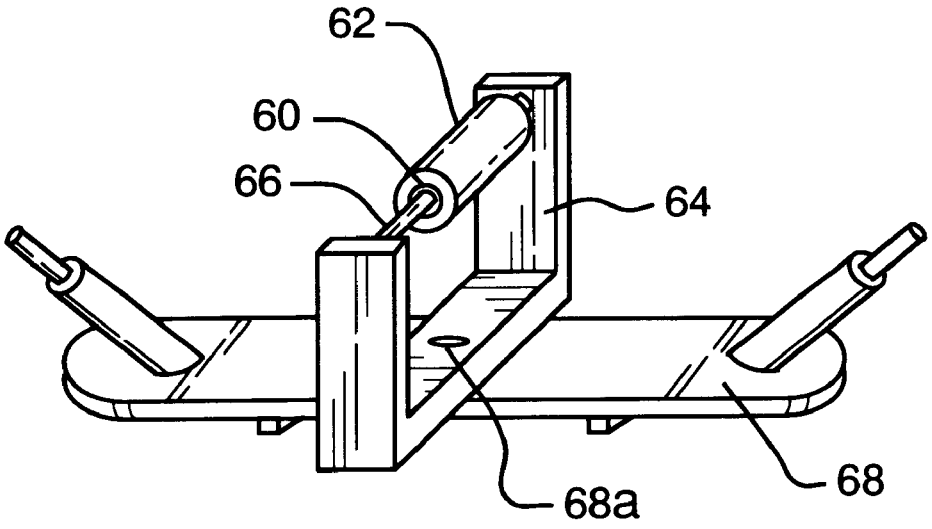
FIG. 7 is a perspective view illustrating the applicator assembly for the invention with revolving medical applicator.

FIGS. 1 and 2 illustrate the use of scrubbing applicators 20, which are temporarily or permanently attached to the base 18. FIGS. 5 to 7 illustrate alternate embodiments of the applicator 20, which are suitable for use with the present invention. For example, the massager assembly 29 (FIG. 5) comprises respectively a plastic ball 30 with protruding bumps 31. The applicator can also be configured as small balls mounted on suitable supports 32, 42 and rotatable about axes 38 and 48.

Figure 8:
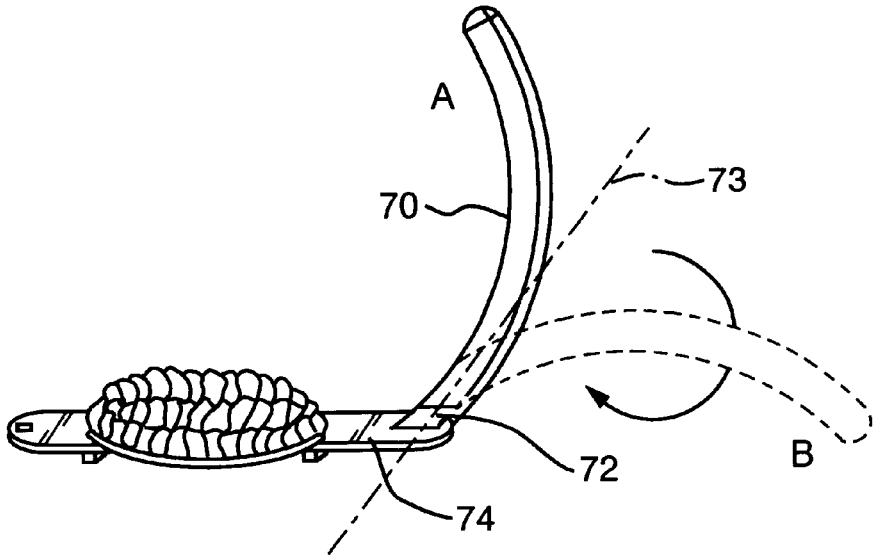
FIG. 8 is a perspective view of the body care applicator for the invention with a revolving curved handle for washing and scrubbing the body.

Additionally, the massager assembly can revolve around platforms 34, 44, utilizing the axes formed by wing nuts 38*a* and 48*a* (FIGS. 5 and 6). In an alternate embodiment, the assembly can be a medical applicator assembly (FIG. 7) having a plastic cylinder 60 which wraps around a medical core 62 that is replaced after each use. The core is disposed about a support 64. The medical applicator revolves around an axis or support rod 66. The assembly can be secured to the platform 68 with the bolt 68*a* (FIG. 8).

Figure 9:
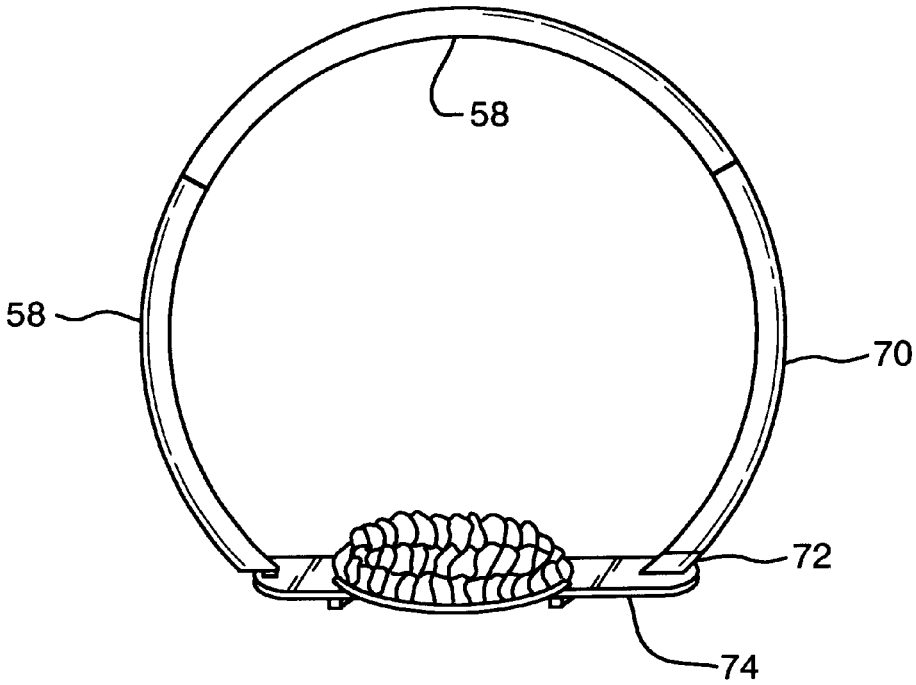
FIG. 9 is a perspective view illustrating the applicator with frame of the invention, which includes the curved handle and additional segments.

The encircling frame assembly 12 can include a revolving curved handle 70 (FIGS. 8 and 9) connected to the clamping elements 22 and 24 of the backing elements at the joint 72. The handle is rotatable about the clamping axis 73 and can be installed at any position between position A and position B (FIG. 8). The interlocking frame of FIG. 4 segments can be connected with the curved handle 70 to form the full frame assembly 12 of the body care device (FIG. 9).

Figure 10A:
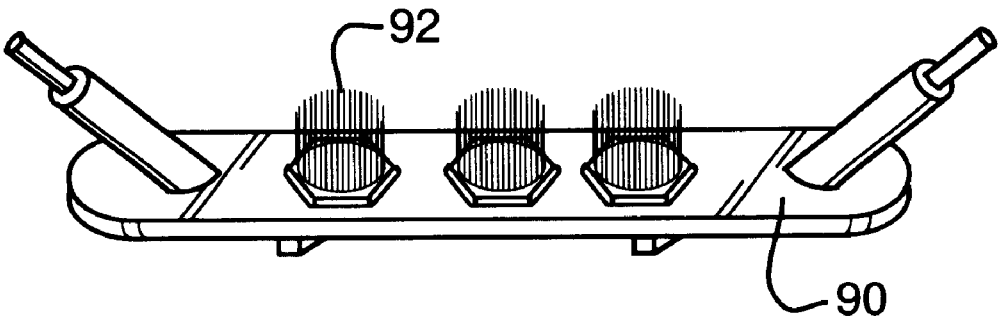
FIGS. 10A and 10B are perspective views illustrating an alternative base and applicator, respectively, for the invention.
Figure 10B:
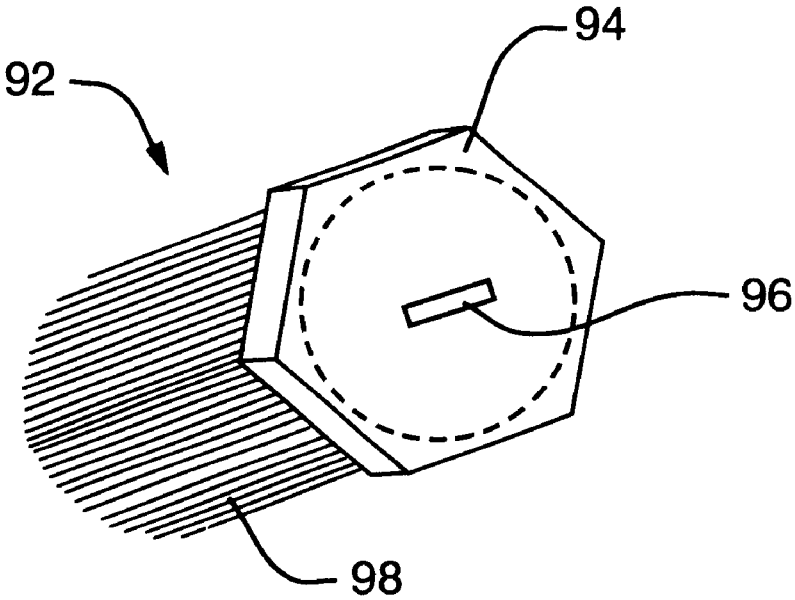

Base 90, FIG. 10*a*, carries three brush applicators 92 best shown in FIG. 10*b*. Applicators 92 include plastic bristles 98 that are fused at the bottoms to plastic base 94 from which pin 96 projects that fits in a properly sized opening in base 90. This interfitting arrangement allows the brushes to be removed and replaced as desired.

Figure 11A:
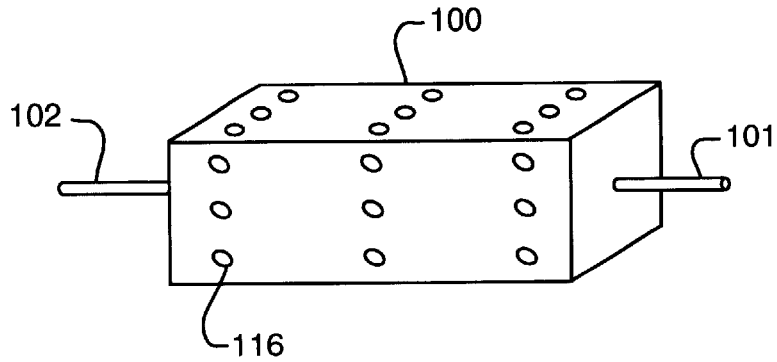
FIGS. 11A through 11C are views of another base and applicator for this invention.
Figure 11B:
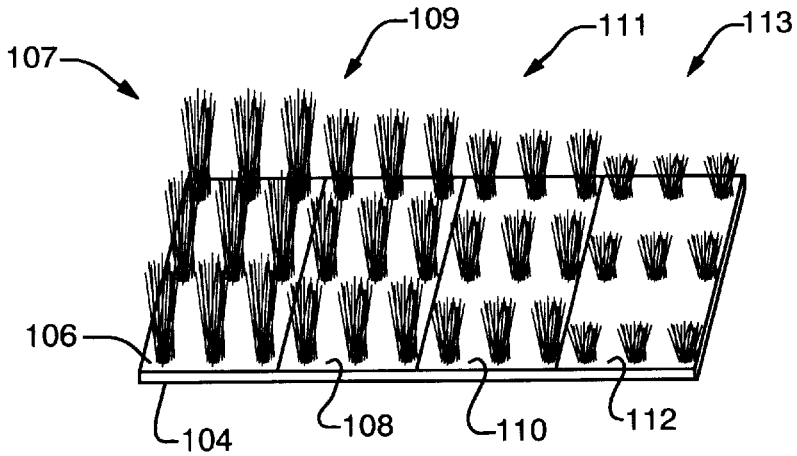
Figure 11C:
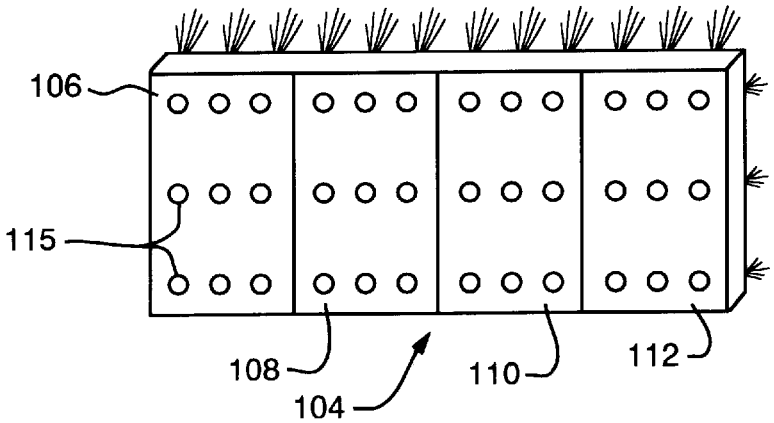

An applicator that defmes a number of different brush types is shown in FIG. 11. Base 100 includes projecting pins 101 and 102 and holes 116 that receive pins 115 projecting from the bottom of applicator member 104. Applicator 104 includes a flat, plastic portion comprising sections 106, 108, 110 and 112 divided by living hinges so that the member can be folded around base 100 such that pins 115 fit in holes 116. Different brushes or other applicator types are integral with member 104. Shown is a brush having long filaments 107, shorter filaments 109, still shorter filaments 111 and shortest filaments 113. Thus, one device can provide in effect four different applicator types. This base is designed for use with base receiving section 120, FIG. 12*a*, which defines pin receiving openings 122 and 124. These openings can be enabled to allow rotation of the base or a snap-fit so that the base can be easily removed and turned to present a different applicator surface. Member 120 also defines openings 126 that can receive pins in an applicator that fits down into member 120, examples of which are shown in FIGS. 12*c* and 12*d*. FIG. 12*b* shows an applicator similar to that shown in FIG. 11, with projecting pins 131 and 132 that allow rotation of applicator 130 relative to base 120. Brushes 134 project from member 130. A removable applicator 140, FIG. 12*c*, has pins 148 that fit in openings 126, and carries brushes 146. U shaped projecting handle 144 fits in this space in member 120 below portion 142, and provides a grasping handle that allows member 140 to be removed from member 120 and held in a hand and used as a scrub brush. FIG. 12*d* shows a battery or line power operated electric massage device 127 that also fits in member 120 by engagement of pins 129 and openings 126.

Figure 12A:
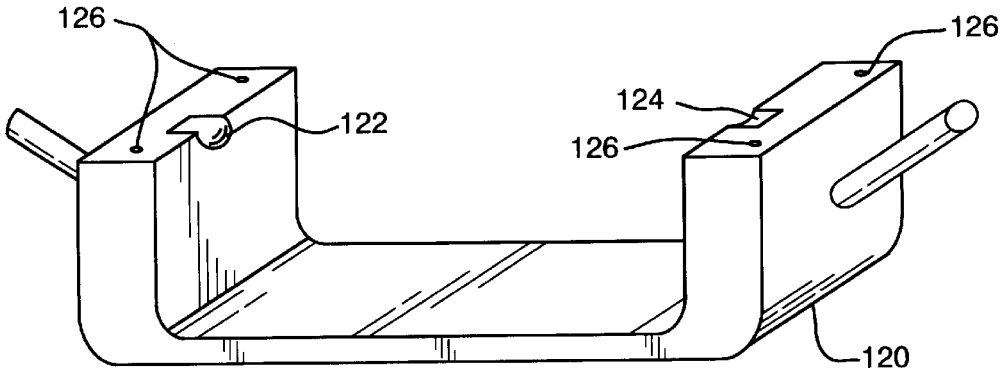
FIGS. 12A through 12D are views of yet another base and three different applicators that fit the base for use in this invention.
Figure 13A:
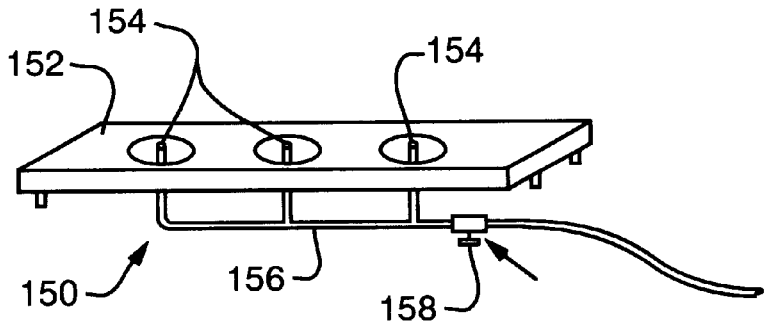
FIGS. 13A through 13C are views of another base and two applicators that fit within the base for use with this invention.
Figure 13B:
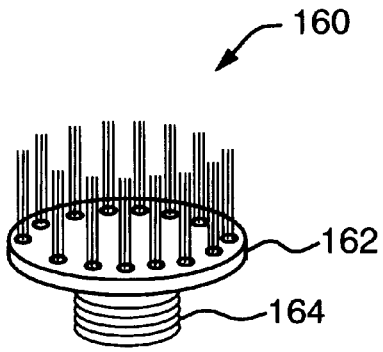
Figure 13C:
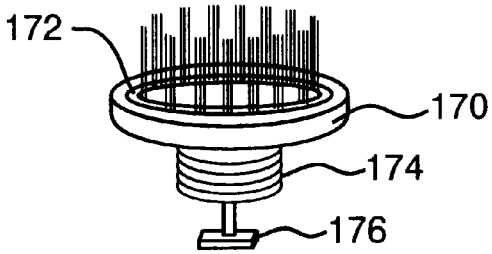

FIG. 13 schematically depicts yet another base and applicator types. Base 150 has pins that allow it to be removably coupled to member 120, FIG. 12*a*. Threaded openings 154 accept the threads of applicators 160 and 170, threaded portions 164 and 174, respectively. Flexible water supply line 156 leads to each of openings 154 so that water can be supplied to the unit under control of valve 158. Applicator 160 has base 162 that carries brushes and defines a number of openings through which water is sprayed to provide a scrubbing and cleaning function. Applicator 170 includes rotating brush portion 172 that is driven to rotate by water entering through line 156 under control of valve 176. These two applicators can be used interchangeably in the base of FIG. 13*a* to provide rotating and fixed scrubbing and water spray as desired.

Figure 12B:
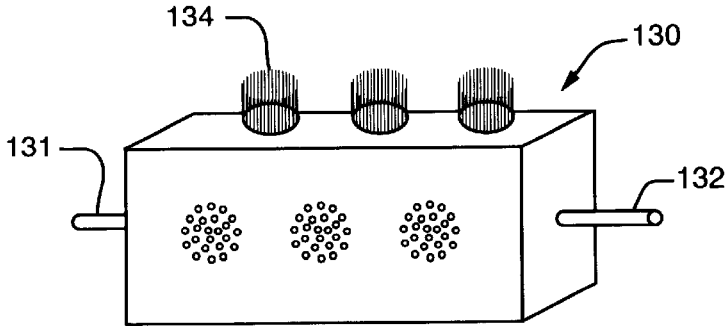
Figure 12C:
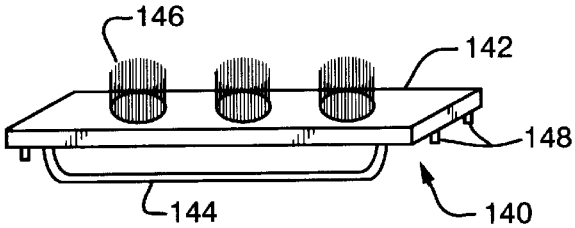
Figure 12D:
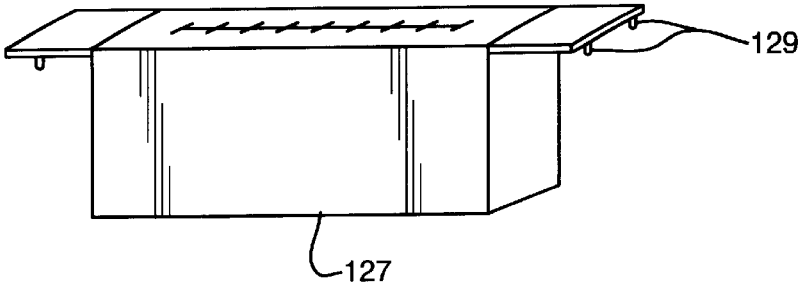
Figure 14:
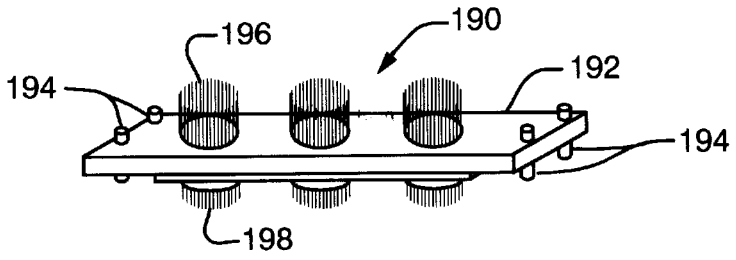
FIG. 14 is a view of yet another base for this invention with applicators on two sides.

FIG. 14 depicts yet another base with applicators designed to fit in member 120, FIG. 12*a*. Member 190 includes flat portion 192 with pins 194 projecting from both faces. Pins 194 are adapted to fit in openings 126, FIG. 12*a*. Brushes 196 on one face are different than brushes 198 on the other face so that this member can accomplish at least two types of applicators.

Figure 15A:
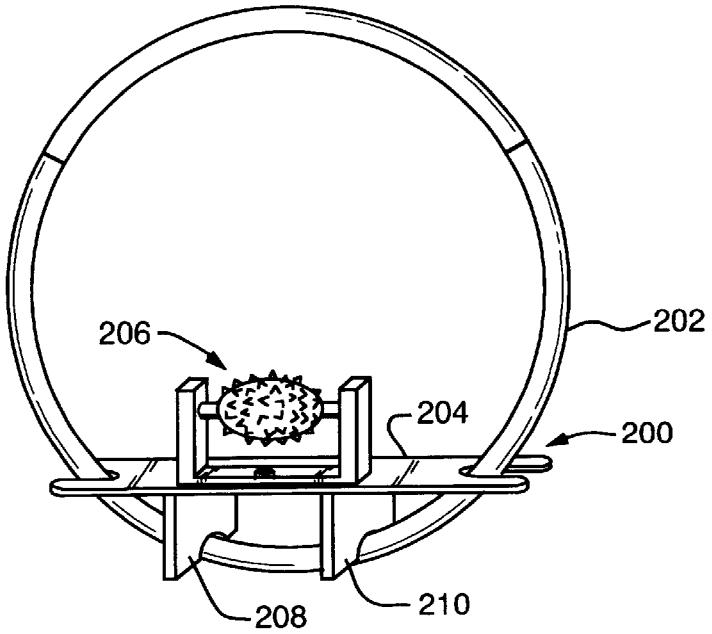
FIGS. 15A and 15B are views of another alternative base for use with a different style frame according to this invention.
Figure 15B:
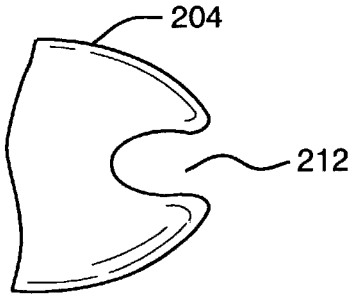

Finally, FIGS. 15*a* and 15*b* depict yet another base which is adapted to be used with a full hoop or closed circular frame 202 of the type known in the art. Member 200 includes planar portion 204 and projecting leg portions 208 and 210, each of which is adapted to removably connect to hoop 202. This interconnection is preferably accomplished by creating a partially closed opening such as opening 212, FIG. 15*b*, that can snap over hoop 202 and be removed there from. This provides additional functionality to the closed hoop frame known in the art. Member 200 carries applicator 206 of a type described herein.

The above examples and preferred embodiments should not be construed as limiting the invention as fully set forth in the claims which follow the description. All references, including patents and printed publications, cited in this specification are hereby incorporated in their entireties by reference.

I claim:

1. A self-treatment body care apparatus comprising:

an elongated base having two ends and defining connectors comprising openings or projections proximate both ends;

an open ended curved, stiff frame having two ends, the frame for circumscribing a portion of a human torso, the frame comprising a plurality of interlocking sections, and defining at both ends connectors comprising openings or projections that are adapted to releasably couple with the base connectors, to removably connect the base to the frame; and a scrubbing brush applicator which releasably attaches to the base.

2. The apparatus of claim 1, wherein the applicator revolves.

3. The apparatus of claim 1, wherein the frame is a plastic material.

4. The apparatus of claim 1, wherein the frame is collapsible.

5. The apparatus of claim 2, wherein the collapsed frame forms a handle for the base.

6. The apparatus of claim 5, wherein the frame can be enlarged by adding interlocking sections to accommodate a larger torso.

7. The apparatus of claim 1, wherein the applicator comprises a sponge.

8. The apparatus of claim 1, wherein the applicator comprises an absorbent pad.

9. The apparatus of claim 1, wherein the applicator comprises a massaging device.

10. The apparatus of claim 1, wherein the applicator comprises a medicinal applicator.

11. The apparatus of claim 1, wherein the applicator revolves relative to the frame.

12. The apparatus of claim 1, wherein the base allows the apparatus to stand upright.

13. The apparatus of claim 12, wherein the base is flat or footed.

14. The apparatus of claim 1, wherein the applicator comprises a plastic base portion with plastic bristles fused thereto.

15. The apparatus of claim 1, wherein the applicator defines one or more projections which are releasably received in corresponding openings in the base.

16. The apparatus of claim 1, wherein the frame defines two openings for receiving projecting members projecting from the base.

17. The apparatus of claim 1, wherein the base is generally rectangular in cross-section.

18. The apparatus of claim 17, wherein the applicator is a unitary, generally rectangular member with three living hinges defining four separate applicator sections that lie on each of the four faces of the base.

19. The apparatus of claim 18, in which different applicators are accomplished in at least two of the four sections of the generally rectangular applicator.

20. The apparatus of claim 1, wherein the base is generally U shaped to define an opening for receiving an applicator-carrying member.

21. The apparatus of claim 20, wherein the applicator-carrying member is releasably attached to the base by projecting members.

22. The apparatus of claim 1, wherein the base comprises a tube for carrying water to the base, and wherein at least one applicator delivers water provided to the base through the tube.

23. The apparatus of claim 22, wherein at least one applicator is driven by the water to rotate.

24. The apparatus of claim 20, wherein the base is double-sided and is removably attached to the U shaped member, and carries different applicators on each face.

* * * * *